US009376841B2

(12) United States Patent
Chan

(10) Patent No.: US 9,376,841 B2
(45) Date of Patent: Jun. 28, 2016

(54) FLEXIBLE U-LOCK

(71) Applicant: Bell Sports, Inc., Scotts Valley, CA (US)

(72) Inventor: Andy Yu Sang Chan, Chai Wan (HK)

(73) Assignee: Bell Sports, Inc., Scotts Valley, CA (US)

( * ) Notice: Subject to any disclaimer, the term of this patent is extended or adjusted under 35 U.S.C. 154(b) by 0 days.

(21) Appl. No.: 14/476,389

(22) Filed: Sep. 3, 2014

(65) Prior Publication Data

US 2015/0059420 A1 Mar. 5, 2015

Related U.S. Application Data

(60) Provisional application No. 61/873,678, filed on Sep. 4, 2013.

(51) Int. Cl.

| | |
|---|---|
| ***E05B 67/06*** | (2006.01) |
| ***E05B 67/00*** | (2006.01) |
| ***E05B 17/00*** | (2006.01) |
| *E05B 71/00* | (2006.01) |
| *E05B 47/00* | (2006.01) |

(52) U.S. Cl.

CPC ..... *E05B 67/06* (2013.01); *E05B 17/0004* (2013.01); *E05B 67/003* (2013.01); *E05B 47/0012* (2013.01); *E05B 71/00* (2013.01); *Y10T 29/49609* (2015.01); *Y10T 70/409* (2015.04); *Y10T 70/491* (2015.04)

(58) Field of Classification Search

CPC . Y10T 70/491; Y10T 70/5872; Y10T 70/413; Y10T 70/409; Y10T 70/483; Y10T 70/40; Y10T 70/489; Y10T 70/435; Y10T 29/49609; E05B 71/00; E05B 67/003; E05B 67/22; E05B 73/005; E05B 47/0012; E05B 67/06; E05B 17/0004

USPC ..... 70/20, 38 R, 53, 233–236, 49, 18, 30, 70/38 B, 38 C

See application file for complete search history.

(56) References Cited

U.S. PATENT DOCUMENTS 4,028,916 A * 6/1977 Pender ..... 70/233
5,279,135 A * 1/1994 Leyden ..... E05B 69/006 70/18

(Continued)

OTHER PUBLICATIONS freeformfabrication; http://www.techbriefs.com/component/content/article/478; Nov. 24, 2009; J. Kevin Watson, Daniel D. Petersen, Karen M. Taminger, Robert A. Hafley; Lyndon B. Johnson Space Center.*

(Continued)

*Primary Examiner* — Suzanne Barrett
*Assistant Examiner* — Morgan McClure
(74) *Attorney, Agent, or Firm* — Booth Udall Fuller, PLC

(57) ABSTRACT

A lock comprising a shackle and a shackle-receiving portion. The shackle can comprise a resilient flexible portion, which, absent any external deformation forces, can retain an overall substantially U-shaped form. The shackle-receiving portion can comprise a locking mechanism operable to secure the shackle to the shackle-receiving portion. The substantially U-shaped form can comprise substantially straight and parallel legs. The flexible portion can further comprise a heat-treated coil spring that maintains the overall substantially U-shaped form, and the shackle can further comprise a cable.

16 Claims, 9 Drawing Sheets

(56) References Cited

U.S. PATENT DOCUMENTS

| | | | | |
|---|---|---|---|---|
| 7,446,659 | B2 * | 11/2008 | Marsilio et al. | 340/568.1 |
| 8,505,344 | B2 * | 8/2013 | Su | 70/58 |
| 8,904,831 | B2 * | 12/2014 | Stevens | 70/14 |
| 8,963,002 | B2 * | 2/2015 | Wang | 174/69 |
| 2002/0166351 | A1 * | 11/2002 | Lee | 70/49 |
| 2008/0276664 | A1 * | 11/2008 | Shu | 70/18 |
| 2012/0131966 | A1 * | 5/2012 | Yuan | 70/233 |

OTHER PUBLICATIONS

Scott M. Russell and Alan R. Pelton, SMST-2000 Proceedings of the International Conference on Shape Memory and Superelastic Technologies, 2001, SMST, The International Organization on Shape Memory and Superelastic Technology, Apr. 30-May 4, 2000, pp. 12 and 13.*

* cited by examiner

FLEXIBLE U-LOCK

CROSS-REFERENCE TO RELATED APPLICATION

This application claims the benefit of U.S. Provisional Patent Application Ser. No. 61/873,678, filed Sep. 4, 2013, entitled "FLEXIBLE U-LOCK," the contents of which are incorporated herein by this reference in their entirety.

TECHNICAL FIELD

The present disclosure generally relates to the field of locks. In particular, the present disclosure is directed to a U-lock type lock with a flexible shackle.

BACKGROUND

Portable lock systems with U-shaped shackles have grown in popularity since their conception due primarily to the level of security they provide. A category known as "U-locks" has developed particularly suited for locking bicycles and other larger items to structures, characterized generally by having a shackle substantially larger than the lock body. Other locks suitable for such uses, such as cable locks, are typically more vulnerable to thieves because they tend to rely on thinner, braided steel cables that are easier to cut through than the hardened steel shackle used in typical U-locks. However, many users nonetheless prefer cable locks to U-locks due to their versatility and price-point. Cable locks can be used in situations where a typical U-lock shackle may be too awkward or narrow to fit, such as around a telephone pole or a tree, while typical U-locks may be limited to somewhat more-specific situations, such as locking a bicycle to a bicycle rack. Despite any such disadvantages, U-locks have garnered a reputation as one of the most secure portable locks available, a reputation that can cause would-be thieves to pass by U-locked items that they may otherwise attempt to steal if they were secured with a less-secure lock such as a cable lock. Nonetheless, many users still prefer cable locks even in view of the possible lower security for the reasons mentioned above.

SUMMARY

Embodiments presented herein variously address the lack of security associated with cable locks and the lack of versatility associated with typical U-locks by providing a lock with a flexible, U-shaped shackle and a shackle-receiving portion including a locking mechanism operable to secure the shackle to the shackle-receiving portion. In an exemplary embodiment, a cable is disposed within a sleeve, the sleeved cable is inserted within a flexible, resilient coil spring portion, the coil spring portion is enclosed in a second sleeve, and the cable is secured to a cross-bar in order to form a flexible U-lock. Various alternatives are disclosed.

In an implementation, the present disclosure is directed to a lock including a shackle having a flexible coil spring portion and a shackle-receiving portion including a locking mechanism operable to secure the shackle to the shackle-receiving portion. Coil spring portion may be resilient. Absent any external deformation forces, coil spring portion may retain an overall substantially U-shaped form; this substantially U-shaped form may include substantially straight and parallel legs. The coil spring portion may be heat-treated in order to maintain the overall substantially U-shaped form. The shackle may include a cable and may further include a sleeve disposed between the coil spring portion and the cable and/or an external sleeve. A portion of the shackle may be permanently affixed to the shackle-receiving portion.

In another implementation, the present disclosure is directed to a lock including a shackle having a flexible portion, which, absent any external deformation forces, retains an overall substantially U-shaped form and a shackle-receiving portion including a locking mechanism operable to secure the shackle to the shackle-receiving portion. The flexible portion may be resilient. The substantially U-shaped form may include substantially straight and parallel legs. The flexible portion may include a coil spring, which may be heat-treated in order to maintain the overall substantially U-shaped form. The shackle may include a cable and may further include a sleeve disposed over the cable and/or may include an external sleeve. A portion of the shackle may be permanently affixed to the shackle-receiving portion.

In still another implementation, the present disclosure is directed to a method of making a lock including manufacturing a shackle including a flexible coil spring portion and manufacturing a shackle-receiving portion having a locking mechanism operable to secure the shackle to the shackle-receiving portion. Manufacturing the shackle and the shackle-receiving portion may include manufacturing at least a portion of at least one of the shackle and the shackle-receiving portions using free-form fabrication. Manufacturing the shackle may include heat-treating a coil spring to maintain an overall substantially U-shaped form. Manufacturing the flexible coil spring portion may comprise assembling a spring/cable assembly including a cable slidably disposed within the coil spring. Manufacturing the shackle may include: affixing first and second lock plugs to opposite ends of the spring/cable assembly and/or permanently securing one of the lock plugs into the shackle-receiving portion, the locking mechanism being configured to releaseably receive and lock the opposite lock plug; and/or disposing an inner sleeve between the cable and the coil spring; and/or disposing an outer sleeve over the coil spring.

In yet another implementation, the present disclosure is directed to a method of making a lock including manufacturing a shackle including a flexible portion, which, absent any external deformation forces, retains an overall substantially U-shaped form and manufacturing a shackle-receiving portion including a locking mechanism operable to secure the shackle to the shackle-receiving portion. Manufacturing the shackle and the shackle-receiving portion may comprise manufacturing at least a portion of at least one of the shackle and the shackle-receiving portions using free-form fabrication. Manufacturing the shackle may include heat-treating a coil spring to maintain an overall substantially U-shaped form and/or slidably disposing a cable within the flexible portion; first and second lock plugs may be affixed to opposite ends of the cable. Manufacturing the shackle may further include: permanently securing one of the lock plugs into the shackle-receiving portion, the locking mechanism being configured to releaseably receive and lock the opposite lock plug; and/or disposing an outer sleeve over the cable; and/or heat-treating a coil spring to maintain an overall substantially U-shaped form and slidably disposing the cable within the coil spring; and/or disposing an inner sleeve between the cable and the coil spring and/or manufacturing a flexible, tubular structure that maintains an overall substantially U-shaped form and slidably disposing the cable within the flexible, tubular structure; and/or disposing an inner sleeve between the cable and the flexible, tubular structure.

In another embodiment, a lock can comprise a shackle comprising a resilient flexible portion, which, absent any external deformation forces, retains an overall substantially U-shaped form. The lock can also comprise a shackle-receiving portion comprising a locking mechanism operable to secure the shackle to the shackle-receiving portion.

The lock can optionally comprise the substantially U-shaped form comprising substantially straight and parallel legs. The flexible portion can further comprise a heat-treated coil spring that maintains the overall substantially U-shaped form. The shackle can further comprise a cable. The shackle can further comprise a sleeve disposed over the cable. The shackle can further comprise an external sleeve. At least a portion of the shackle can be permanently affixed to the shackle-receiving portion.

In another embodiment, a lock can comprise a shackle comprising a flexible coil spring portion and a shackle-receiving portion comprising a locking mechanism operable to secure the shackle to the shackle-receiving portion.

The lock can optionally comprise the coil spring portion being resilient and heat-treated in order to maintain an overall substantially U-shaped form. Absent any external deformation forces, the coil spring portion can retain an overall substantially U-shaped form. The substantially U-shaped form can comprise substantially straight and parallel legs. The shackle can further comprise a cable. The shackle can further comprise a sleeve disposed between the coil spring portion and the cable, and an external sleeve disposed around the coil spring and the cable. At least a portion of the shackle can be permanently affixed to the shackle-receiving portion.

In another embodiment, a method of making a lock can comprise manufacturing a shackle comprising a flexible coil spring portion, and manufacturing a shackle-receiving portion comprising a locking mechanism operable to secure the shackle to the shackle-receiving portion.

The method of making the lock can optionally include manufacturing at least a portion of at least one of the shackle and the shackle-receiving portions using free-form fabrication. Manufacturing the shackle can comprise heat-treating a coil spring to maintain an overall substantially U-shaped form. Manufacturing the flexible coil spring portion can comprise assembling a spring-cable assembly comprising a cable slidably disposed within the coil spring. Manufacturing the shackle can further comprise affixing a first lock plug to a first end of the spring-cable assembly, affixing a second lock plug to a second end of the spring-cable assembly opposite the first end of the spring-cable assembly, and permanently securing the first lock plug into the shackle-receiving portion, the locking mechanism being configured to releasably receive and lock the second lock plug. Manufacturing the shackle can further comprise disposing a sleeve adjacent the coil spring.

These and other aspects and features will become apparent to those skilled in the art upon review of the following description of specific non-limiting embodiments disclosed in conjunction with the accompanying drawings.

BRIEF DESCRIPTION OF THE DRAWINGS

The drawings show various non-limiting aspects of one or more embodiments disclosed in the written description. However, it should be understood that the present disclosure is not limited to the precise arrangements and instrumentalities shown in the drawings.

The drawings are not necessarily to scale and may be illustrated by phantom lines, diagrammatic representations and fragmentary views. In certain instances, details that are not necessary for an understanding of the embodiments or that render other details difficult to perceive may have been omitted.

DETAILED DESCRIPTION

Embodiments presented in the disclosure overcome the disadvantages of the lack of security associated with cable locks and the lack of versatility associated with typical U-locks. In an exemplary embodiment, an outer sleeve, a flexible, resilient coil spring portion enclosed within the outer sleeve, an inner sleeve disposed within the coil spring portion, and a cable disposed within the inner sleeve; as such, the cable may be secured to a cross-bar in order to form a flexible U-lock.

Figure 1:
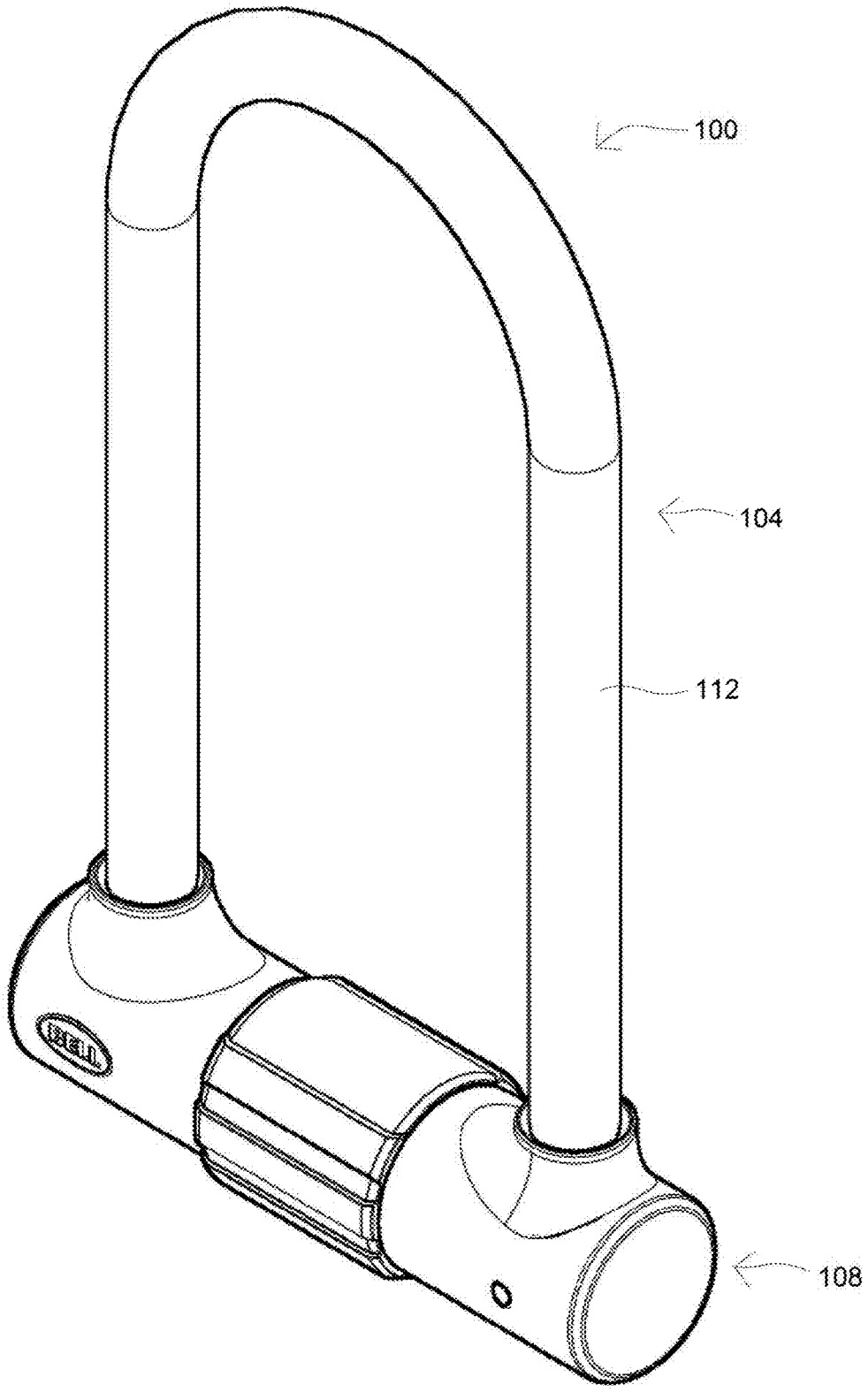
FIG. 1 is a perspective view of a flexible U-lock according to an exemplary embodiment.
Figure 2:
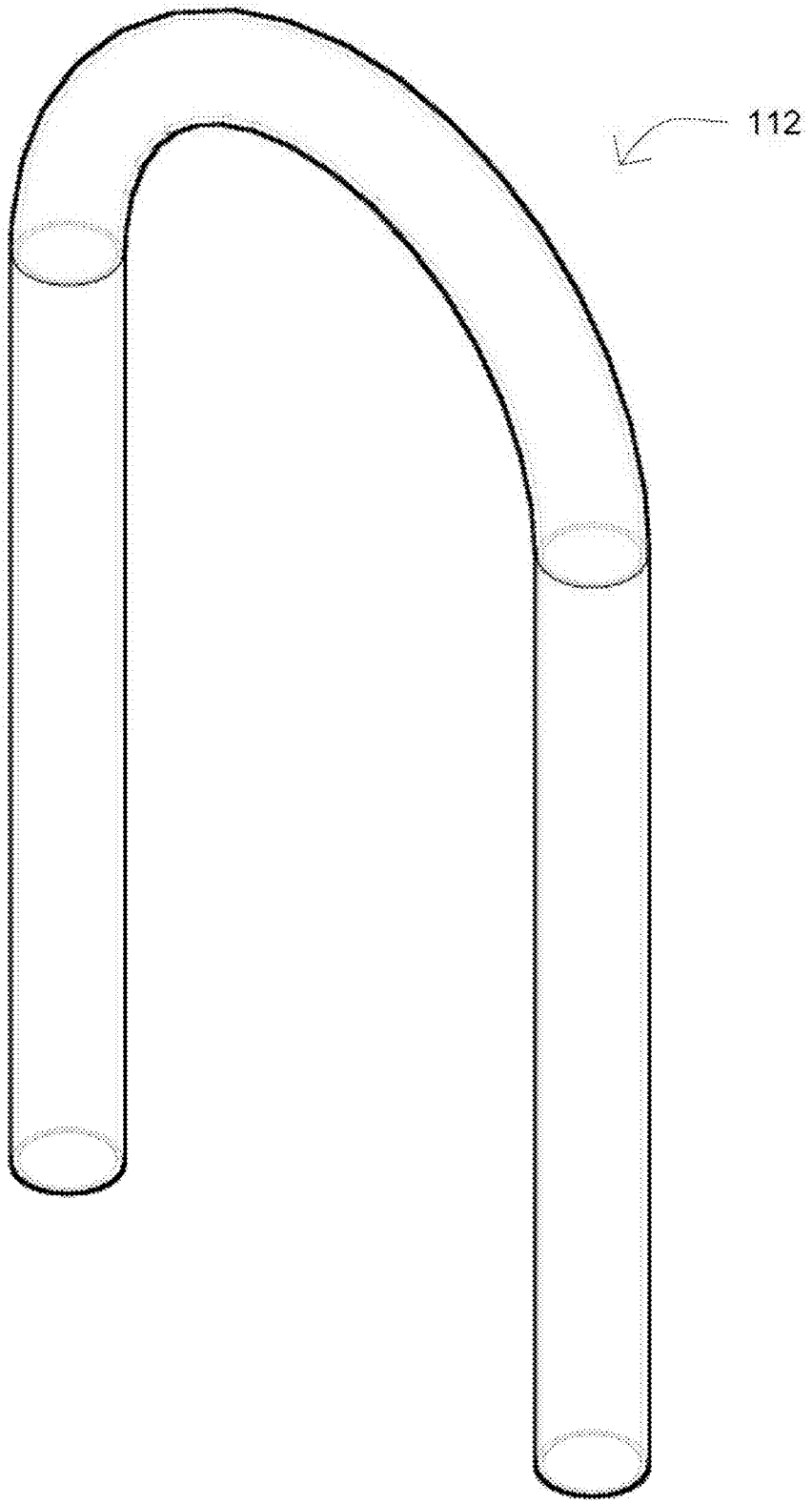
FIG. 2 is a perspective view of the outer sleeve of the flexible U-lock shown in FIG. 1.

FIG. 1 shows an exemplary flexible U-lock 100 comprising a shackle 104 and a cross-bar 108. FIG. 2 depicts an outer sleeve 112 to be disposed on the exterior of shackle 104. Outer sleeve 112 may be formed of a single piece or multiple pieces of material, and can be made from materials such as PVC or any other suitable material that can be disposed on shackle 104 and that, preferably, contributes to imitation of the appearance of a typical U-lock. In order to guarantee flexibility, outer sleeve 112 may be shaped, designed, and configured to allow the parts of shackle 104 within it to move substantially freely relative to it.

Figure 3:
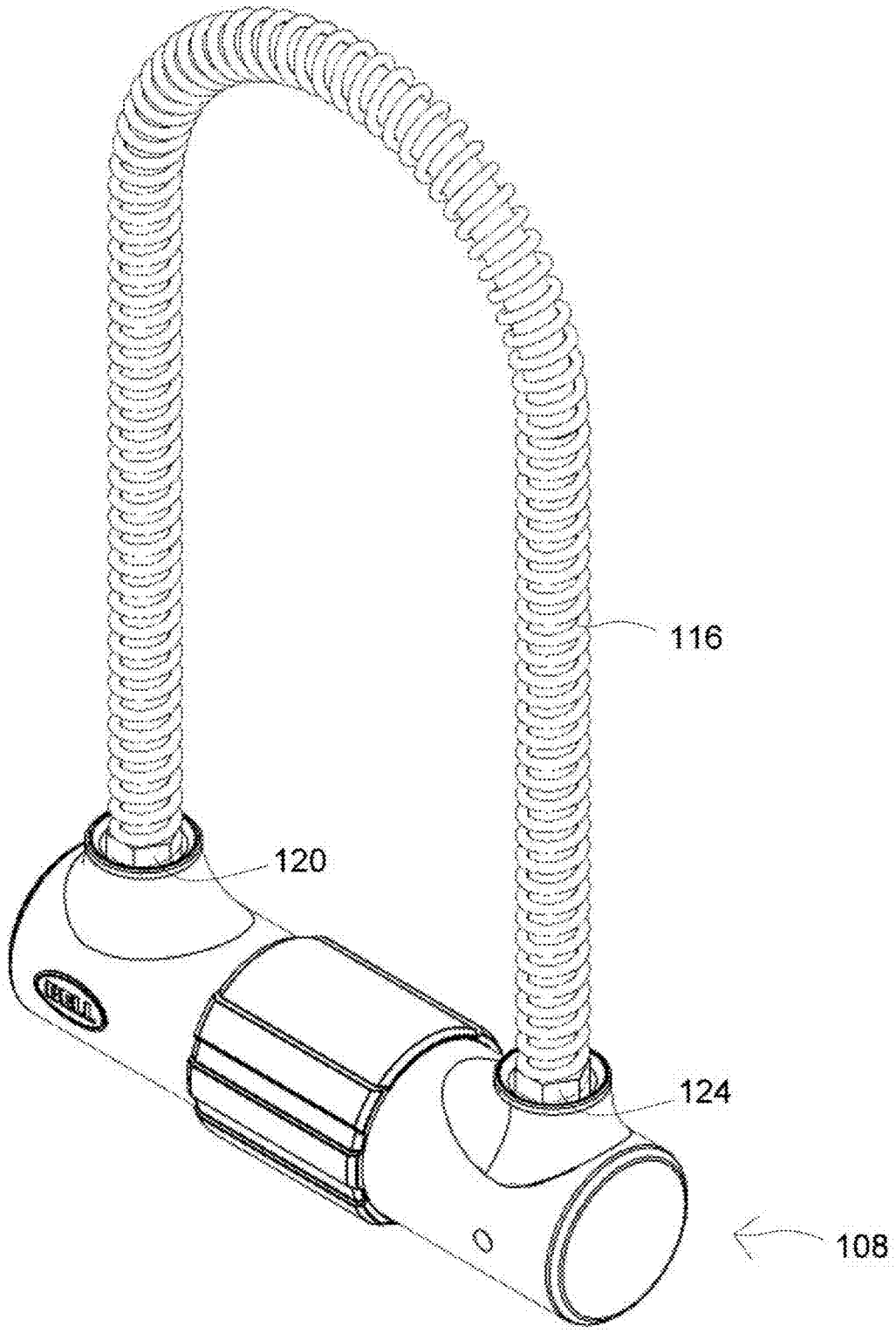
FIG. 3 is a perspective view of the flexible U-lock shown in FIG. 1 with the outer sleeve removed.
Figure 4:
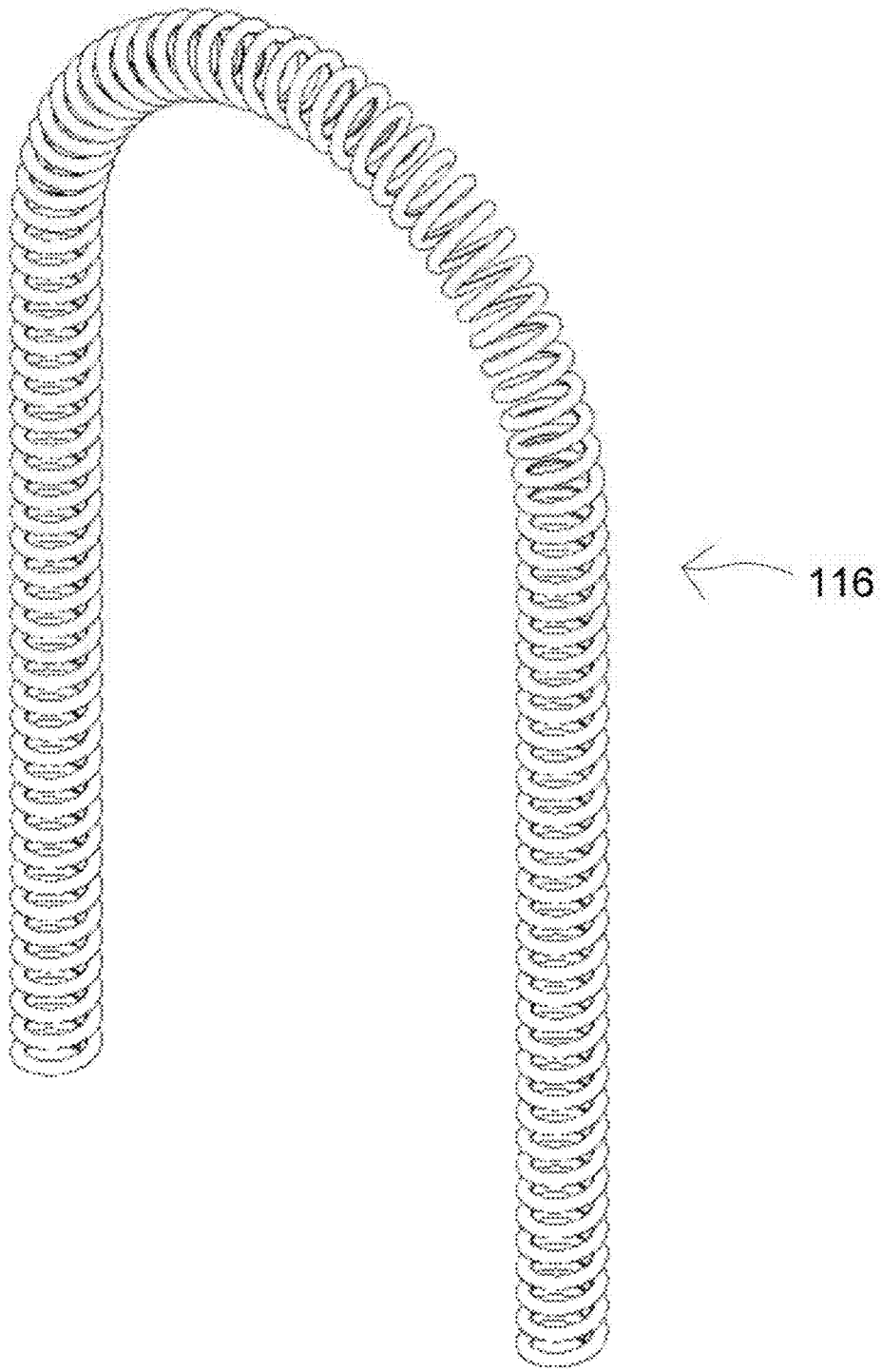
FIG. 4 is a perspective view of the coil spring of a flexible U-lock according to an exemplary embodiment.

FIG. 3 illustrates flexible U-lock 100 of FIG. 1 with sleeve 112 removed, including a flexible, resilient coil spring portion 116 of shackle 104, cross-bar 108, and lock plugs 120, 124. FIG. 4 depicts coil spring portion 116. Coil spring portion 116 may be heat-treated in order to maintain a strong, overall substantially U-shaped form, may be electroplated to provide corrosion protection, and may be shaped, designed, and configured to slide freely within outer sleeve 112 and relative to cross-bar 108.

Figure 5:
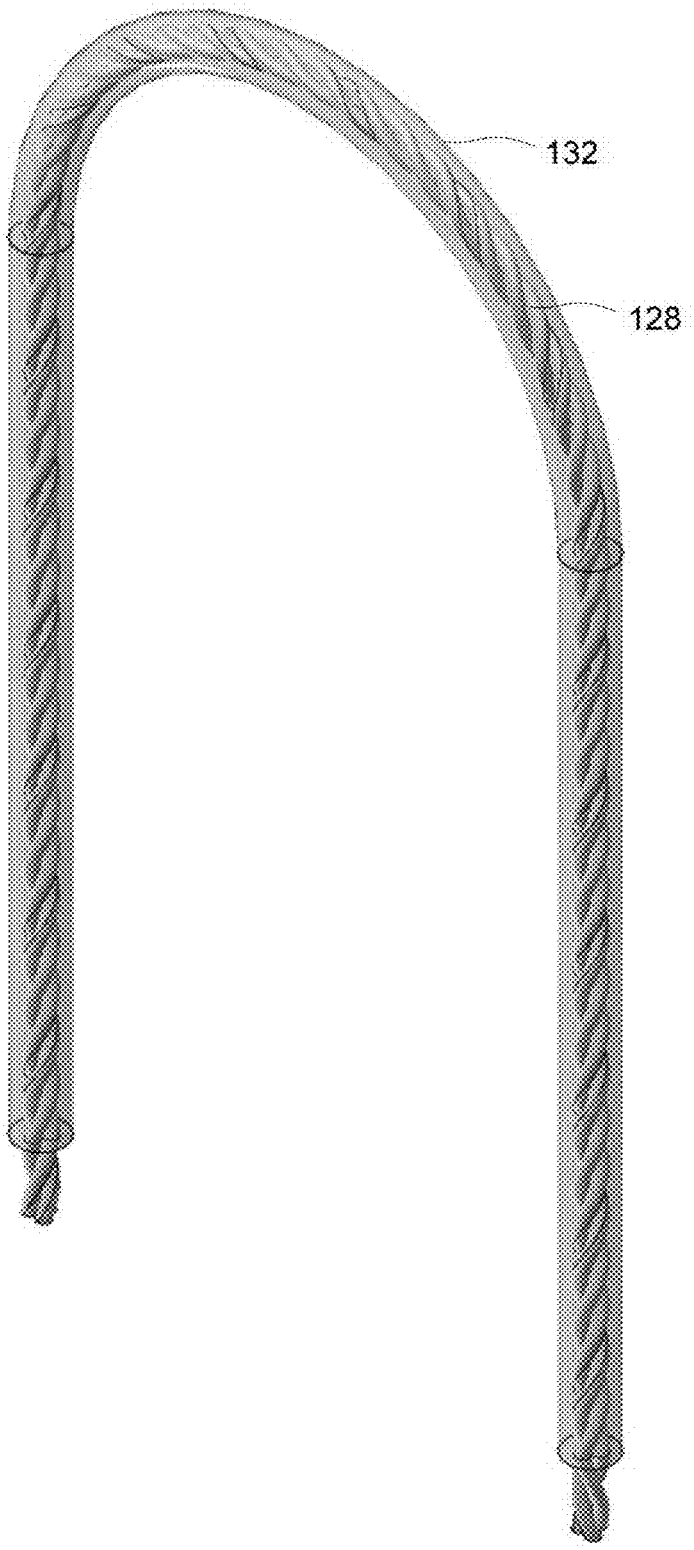
FIG. 5 is a perspective view of a cable and an associated inner sleeve of the flexible U-lock shown in FIG. 1.

FIG. 5 shows an exemplary cable 128 disposed within an optional inner sleeve 132. Inner sleeve 132 may be formed of a single piece or multiple pieces of material, and can be made from materials such as PVC or any other suitable material that can be disposed on cable 128 and that, preferably, provides corrosion protection for cable 128 and minimizes friction between cable 128 and coil spring portion 116. Cable 128 may be formed from braided steel or any other suitably strong and flexible material, and cable 128 and/or inner sleeve 132 may be shaped, designed, and configured to slide freely within coil spring portion 116. Inner sleeve 132 is illustrated as transparent in FIG. 5 so as to reveal cable 128 disposed therein. In practice, inner sleeve 132 may or may not be transparent, depending on the material selected.

Figure 6A:
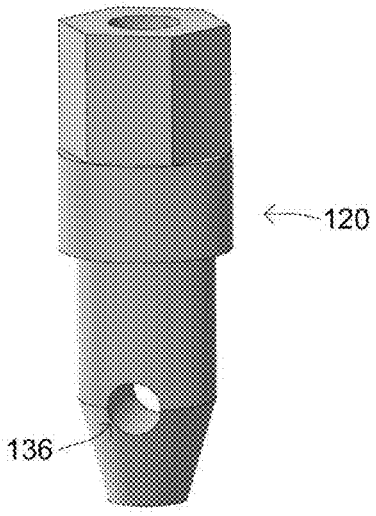
FIG. 6A is a perspective view of a permanently-fixable lock plug according to an embodiment.
Figure 6B:
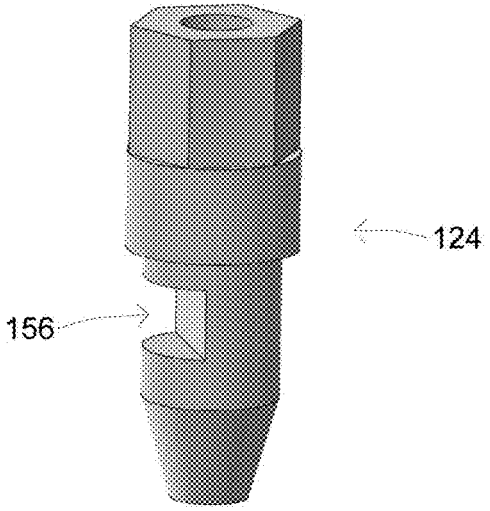
FIG. 6B is a perspective view of a releasably-securable lock plug according to an embodiment.

FIGS. 6A and 6B provide detailed views of lock plugs 120, 124 shown in FIG. 3. FIG. 6A depicts a permanently-fixable lock plug 120 including a pin-hole 136, while FIG. 6B depicts a releasably-securable lock plug 124. Permanently-fixable lock plug 120 may be permanently affixed to one end of cable 128, such as by swaging, press-fitting, or other means known in the art for the purpose, and permanently mounted within cross-bar 108 and secured by a pin 152 or other suitable securing means. Releasably-securable lock plug 124 may be permanently affixed to the opposite end of cable 128 from permanently-fixable lock plug 120 in the same manner and may include a transverse cut 156 designed and configured to communicate with a locking mechanism as described below. In some instances, releasably-securable lock plugs 124 may be permanently affixed to each end of cable 128; this would allow shackle 104 to be completely removed from cross-bar 108 and can facilitate shipping, storage, part replacement, etc.

Figure 7:
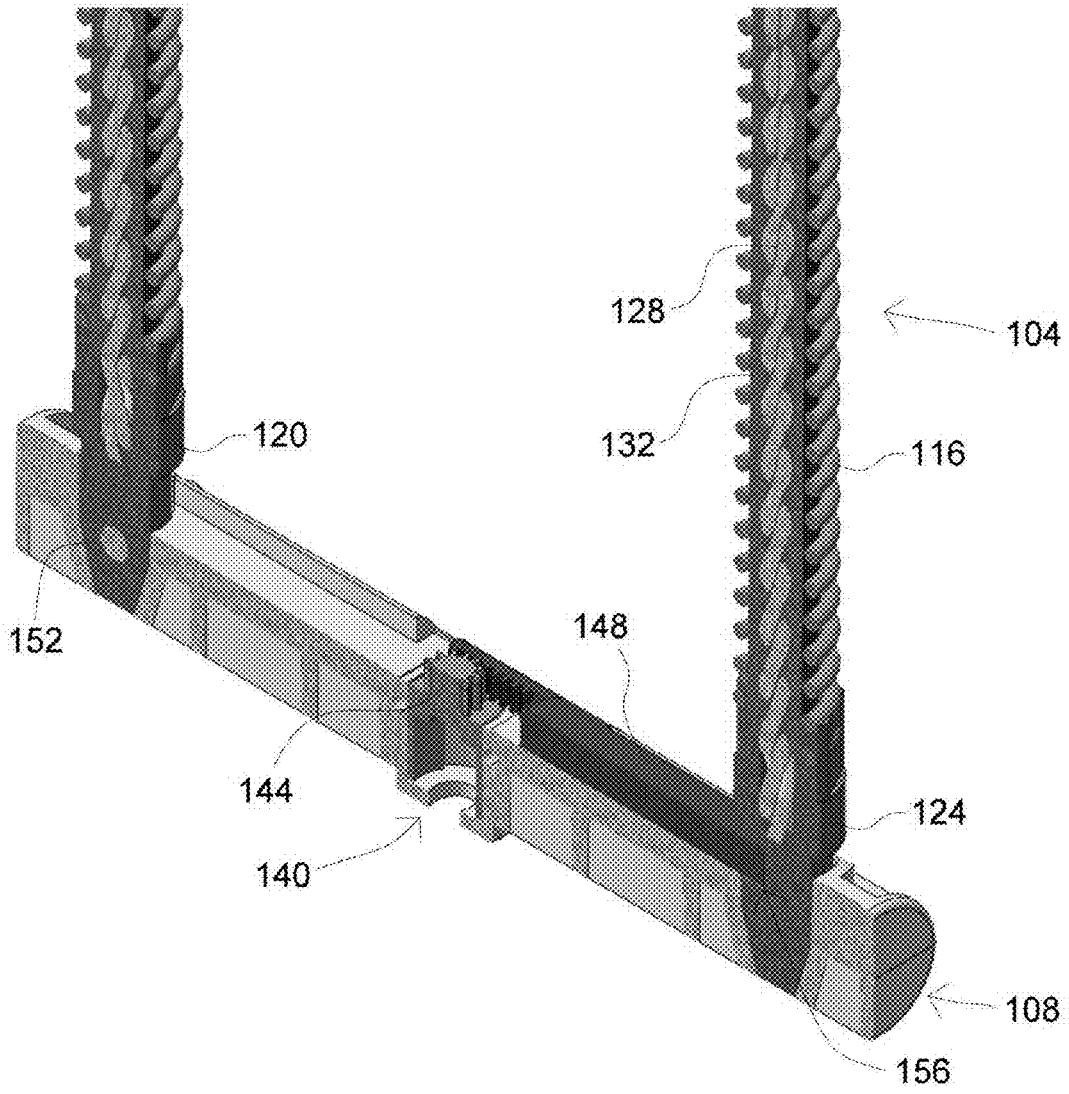
FIG. 7 is a cross-section view of the cross-bar, locking mechanism, lock plugs, and lower portion of the shackle (shown with the outer sleeve removed for clarity) of the flexible U-lock shown in FIG. 1.

FIG. 7 illustrates a cross-section of a lower portion of flexible U-lock 100 of FIG. 1, including a cable 128 permanently affixed to a permanently-fixable lock plug 120 at one end and a releasably-securable lock plug 124 at the other end, a coil spring portion 116, and a locking mechanism 140 including a gear 144 and a dead-bolt 148. Here, locking mechanism 140 is shown in its locked position: a pin 152 affixes permanently-fixable lock plug 120 to cross-bar 108 while dead-bolt 148 within locking mechanism 140 engages transverse cut 156 in releasably-securable lock plug 124. In order to unlock locking mechanism 140, a key (not shown) may be inserted into locking mechanism 140 in a conventional manner in order to rotate gear 144; gear 144 in turn slides dead-bolt 148 away from releasably-securable lock plug 124, and, upon dead-bolt 148 being fully retracted, releasably-securable lock plug 124 may be removed from cross-bar 108. If releasably-securable lock plugs 124 are provided on each end of cable 128, an additional dead-bolt (not shown) can be provided on the opposite side of gear 144 that functions in essentially the same fashion as dead-bolt 148 or in any other suitable fashion known in the art.

FIG. 7 also illustrates in more detail the configuration of flexible shackle 104 according to one embodiment that provides a conventional U-lock U-shape with substantially straight, parallel legs entering cross-bar 108 at substantially right angles, while at the same time providing the convenience of a flexible shackle normally associated with a cable lock. Cable 128 provides both strength and flexibility, but a cable alone would be floppy and not maintain the desired U-shape. Thus, heat treated coil spring portion 116 surrounds cable 128 to maintain the shape and add increased strength/resistance to cutting. Coil spring 116 is heat treated by conventional heat treating processes to maintain the U-shape as shown as well as the flexibility inherent in a spring structure. Inner sleeve 132 is interposed between cable 128 and coil spring portion 116 in order to provide corrosion protection for cable 128 and to reduce friction between cable 128 and coil spring portion 116, which not only increases the flexibility of shackle 104 but can also facilitate manufacture of shackle 104 by reducing friction during insertion of cable 128 into coil spring portion 116. Outer sleeve 112 (see FIGS. 1 and 2) provides a smooth, weather proof outer appearance generally matching that of a conventional, rigid U-lock. Various embodiments can thus provide enhanced security over conventional cable locks in at least two ways. First, the double layer cable/spring construction provides greater strength. Second, the outer appearance of a conventional, rigid U-lock allows flexible U-locks to take advantage of the increased security reputation of the conventional U-lock, thereby deterring attacks that might otherwise occur if perceived as a conventional cable lock.

Flexible U-locks according to various embodiments thus allow for cable-lock-like versatility while maintaining the appearance and nearly or literally the same security advantages of a typical U-lock. In addition, flexible U-locks can be produced more cheaply, and thus sold at lower price-points, than traditional U-locks.

Figure 8:
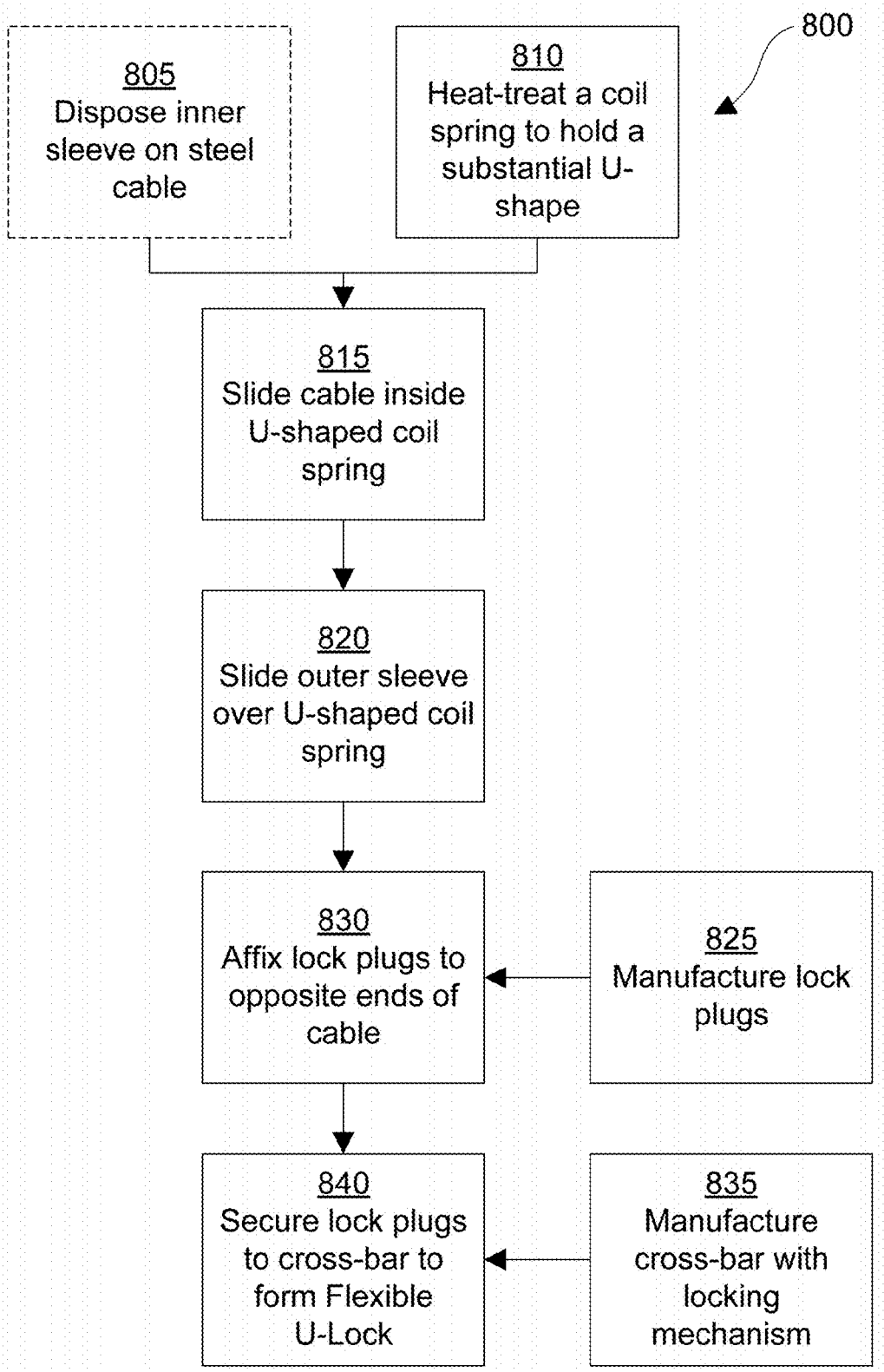
FIG. 8 is a flow diagram of a method of making a flexible U-lock according to an exemplary embodiment.

As shown in FIG. 8, a method of making a flexible U-lock 800 can involve, at optional step 805, disposing an inner sleeve on a cable; this can be performed through coating, sliding, or any other suitable means. At step 810, a coil spring is heat-treated such that it holds a substantial U-shape. As indicated by the flow diagram, steps 805 and 810 can be performed simultaneously or at different times. At step 815, the cable, sleeved or not, is slid or otherwise deposited within U-shaped coil spring, and at step 820, an outer sleeve is slid over or otherwise deposited over U-shaped coil spring. At step 825, lock plugs can be manufactured, which can be performed simultaneously with, before, or after any of steps 805-820, and, at step 830, the lock plugs are affixed to opposite ends of the cable. At step 835, a cross-bar with locking mechanism is manufactured, which can be performed simultaneously with, before, or after any of steps 805-830, and, at step 840, lock plugs can be secured to cross-bar to form a flexible U-lock. Though a suitable method has been shown and described, after reviewing this disclosure in its entirety, it will be clear to one of ordinary skill in the art that these steps can be rearranged in any other logical order; for example, steps 815 and 820 could be swapped, steps 825, 830, and 835 may occur before steps 805 and 810, etc. Further, though step 840, as shown and described, entails securing lock plugs to cross-bar, this step need not necessarily be performed; for ease of shipping, storage, part replacement, etc., it may be convenient to secure only one or perhaps even none of the lock plugs cross-bar. Still further, if releasably-securable lock plugs 124 are provided on each end of cable 128, an additional dead-bolt (not shown) can be provided on the opposite side of gear 144 (see FIG. 7) that functions in essentially the same fashion as dead-bolt 148 or in any other suitable fashion known in the art.

Figure 9:
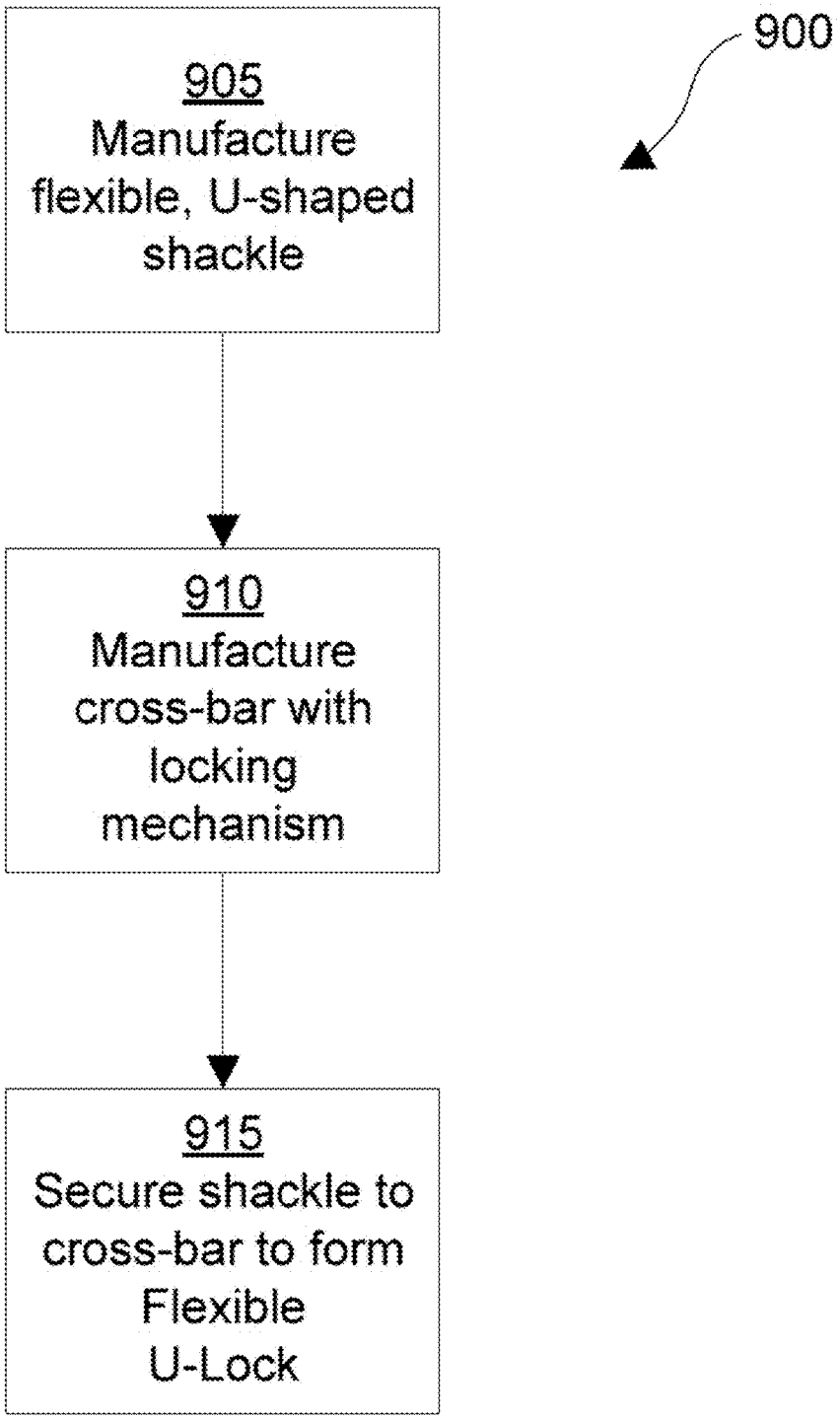
FIG. 9 is a flow diagram of a method of making a flexible U-lock according to an alternative embodiment.

FIG. 9 depicts an alternative method of making a flexible U-lock 900 that can be implemented through free-form fabrication or other known methods and involves, at step 905, manufacturing a flexible, U-shaped shackle, at step 910, manufacturing a cross-bar with a locking mechanism, and, at step 915, securing the shackle to the cross-bar to form a flexible U-lock. Here again, though a suitable method has been shown and described, after reviewing this disclosure in its entirety, it will be clear to one of ordinary skill in the art that steps 905 and 910 could be swapped or performed simultaneously, and, though step 915, as shown and described, entails securing the shackle to the cross-bar, this step need not necessarily be performed; for ease of shipping, storage, part replacement, etc., it may be convenient not to secure the shackle to the cross-bar at the time of manufacture.

Many alternatives to the exemplary embodiments presented are within the scope of the disclosure. For example, a flexible U-lock may be implemented without using inner sleeve 132 or cable 128; in this case, coil spring portion 116 may be directly attached to lock plugs 120, 124. In this context, coil spring portion 116 and lock plugs 120, 124 may be free-form fabricated as a single piece using known free-form fabrication methods. Likewise, cable 128 and lock plugs 120, 124 may be free-form fabricated or fixed to each other using known methods. Other parts of a flexible U-lock may also be free-form fabricated or formed through over known processes as desired; doing so may save manufacturing costs and/or provide a more-reliable product. For example, an overall substantially U-shaped coil spring could be free-form fabricated or manufactured by other known processes, which may not require heat-treating. As such, coil spring portion 116 may be implemented through means other than a literal coil spring, such as any suitably flexible and tubular structure (not shown) that fits between outer sleeve 112 and cable 128. Using free-form fabrication or other known processes, shackle 104, cross-bar 108, an entire flexible U-lock 100, or individual portions thereof, may be formed as a unitary structure and/or layered with structures equivalent to one or more of cable 128, inner sleeve 132, coil spring portion 116, outer sleeve 112, lock plugs 120, 124, pin 152, or any other parts disclosed in the exemplary embodiment discussed herein as desired. Upon reviewing this disclosure in its entirety, one of ordinary skill in the art will understand that it is not necessary to use any of the particular parts discussed in the exemplary embodiment and shown in the drawings in order to make a flexible U-lock according to the present disclosure.

Further, though coil spring portion 116 is described as floating freely between inner 132 and outer 112 sleeves in the context of the exemplary embodiment presented with respect to FIGS. 1-7, it may be desirable to permanently affix coil spring portion 116 to cross-bar 108 at one end and/or to lock plugs 120, 124 at one or both ends in order to increase the security of flexible U-lock 100. Still further, though coil spring portion 116 is described as being resilient in the exemplary embodiment presented with respect to FIGS. 1-7 (in that it retains an overall substantially U-shaped form absent any external deformation forces), it need not be so; in some instances, it may be desirable for users to be able to form the shackle into a specific shape before arranging a flexible U-lock made into position without having to worry about the shackle bouncing back to its original U-shape. In particular instances, it may be desirable to make flexible U-locks with shackles that do not initially have a U-shape but rather an omega-shape or other suitable shape, depending on the desired application.

Inner 132 and outer 112 sleeves may be formed independently from other parts, may be applied as coatings, may be formed simultaneously with other parts via free-form fabrication, as discussed above, or may be left out entirely. Coil spring portion 116, cable 128, sleeves 112, 132, shackle 104, and/or other parts may be coated with low-friction and/or anti-weathering and/or anti-freezing coatings or formed from known materials known to exhibit these or other such desirable qualities.

Finally, though the locking mechanism 140 is described as a combination of a gear 144 and dead-bolt 148 in the context of the exemplary embodiment presented with respect to FIGS. 1-7, it may be implemented using any known, suitable locking mechanism. Though slight modifications may be required based on the desired locking mechanism, it is well within the skill of one of ordinary skill in the art to make such modifications.

Exemplary embodiments have been disclosed above and illustrated in the accompanying drawings. It will be understood by those skilled in the art that various changes, omissions and additions may be made to that which is specifically disclosed herein without departing from the spirit and scope of the present invention as set forth in the appended claims.

What is claimed is:

1. A lock, comprising:

a shackle comprising a resilient flexible portion, the flexible portion comprising a cable slidably disposed within a coil spring, wherein the flexible portion further comprises a heat-treated coil spring that maintains the overall substantially U-shaped form, which, absent any external deformation forces, the flexible portion retains an overall substantially U-shaped form; and a shackle-receiving portion comprising a locking mechanism operable to secure the shackle to the shackle-receiving portion.

2. The lock of claim 1, wherein the substantially U-shaped form comprises substantially straight and parallel legs.

3. The lock of claim 1, wherein the shackle further comprises a cable.

4. The lock of claim 3, wherein the shackle further comprises a sleeve disposed over the cable.

5. The lock of claim 1, wherein the shackle further comprises an external sleeve.

6. The lock of claim 1, wherein at least a portion of the shackle is permanently affixed to the shackle-receiving portion.

7. A lock, comprising:

a shackle, the shackle further comprising:

a cable, a flexible coil spring portion disposed around the cable, a sleeve disposed between the flexible portion and the cable, and an external sleeve disposed around the flexible portion and the cable; and a shackle-receiving portion comprising a locking mechanism operable to secure the shackle to the shackle-receiving portion.

8. The lock of claim 7, wherein the coil spring portion is resilient and heat-treated in order to maintain an overall substantially U-shaped form.

9. The lock of claim 8, wherein, absent any external deformation forces, the coil spring portion retains an overall substantially U-shaped form.

10. The lock of claim 9, wherein the substantially U-shaped form comprises substantially straight and parallel legs.

11. The lock of claim 7, wherein at least a portion of the shackle is permanently affixed to the shackle-receiving portion.

12. The lock of claim 7, wherein the flexible portion further comprises a flexible coil spring portion.

13. A method of making a lock, comprising:

manufacturing a shackle comprising a flexible coil spring portion, wherein manufacturing the shackle comprises heat-treating a coil spring to maintain an overall substantially U-shaped form, and wherein manufacturing the flexible coil spring portion comprises assembling a spring-cable assembly comprising a cable slidably disposed within the coil spring; and manufacturing a shackle-receiving portion comprising a locking mechanism operable to secure the shackle to the shackle-receiving portion.

14. The method of claim 13, wherein manufacturing the shackle and the shackle-receiving portion comprises manufacturing at least a portion of at least one of the shackle and the shackle-receiving portions using free-form fabrication.

15. The method of claim 13, wherein manufacturing the shackle further comprises:

affixing a first lock plug to a first end of the spring-cable assembly;

affixing a second lock plug to a second end of the spring-cable assembly opposite the first end of the spring-cable assembly; and permanently securing the first lock plug into the shackle-receiving portion, the locking mechanism being configured to releasably receive and lock the second lock plug.

16. The method of claim 13, wherein manufacturing the shackle further comprises disposing a sleeve adjacent the coil spring.

* * * * *